US005899606A

United States Patent [19]

Tano et al.

[11] Patent Number: 5,899,606

[45] Date of Patent: May 4, 1999

[54] LIQUID DEVELOPING HEAD LIQUID DEVELOPING UNIT AND IMAGE FORMING APPARATUS

[76] Inventors: Atsushi Tano; Kunihiko Sato; Toshihiro Yukawa; Hiroyuki Inoue, all of Kawasaki, Japan

[21] Appl. No.: 08/942,554

[22] Filed: Oct. 1, 1997

[30] Foreign Application Priority Data

Mar. 18, 1997 [JP] Japan ..... 9-065122

[51] Int. Cl.[6] ..... G03G 15/10

[52] U.S. Cl. ..... 399/239; 399/249; 118/259

[58] Field of Search ..... 399/239, 238, 399/240, 241, 242, 243, 244, 245, 248, 249; 118/258, 259

[56] References Cited

U.S. PATENT DOCUMENTS

| | | |
|---|---|---|
| 3,256,855 | 6/1966 | Oliphant . |
| 4,127,082 | 11/1978 | Kawabata . |
| 4,648,704 | 3/1987 | O'Leary . |
| 5,078,088 | 1/1992 | Nishikawa . |
| 5,396,316 | 3/1995 | Smith . |

FOREIGN PATENT DOCUMENTS

| | | |
|---|---|---|
| 0 685 769 A2 | 12/1995 | European Pat. Off. . |
| 0 685 769 A3 | 5/1997 | European Pat. Off. . |
| 63-19687 | 1/1988 | Japan . |
| 6-3063880 | 9/1989 | Japan . |
| 5-289525 | 11/1993 | Japan . |
| 5-289527 | 11/1993 | Japan . |
| 5-303285 | 11/1993 | Japan . |
| 5-313499 | 11/1993 | Japan . |
| 7-301996 | 11/1995 | Japan . |

OTHER PUBLICATIONS

PCT Application, Intern'l Publication No. WO 92/09014, May 29, 1992.

*Primary Examiner*—Richard Moses

[57] ABSTRACT

A liquid developing head is arranged to confront a surface of an image bearing member via a developing gap and a squeeze gap and carries out a developing by use of a developing liquid. The liquid developing head includes a housing, a developing roller, supported by the housing, supplying the developing liquid to the developing gap by rotating so that a portion of the developing roller confronting the image bearing member moves in a direction which is the same as a moving direction of the surface of the image bearing member, a squeeze roller, supported by the housing and arranged on a downstream side of the developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member, a developing liquid supply path, formed within the housing and having an ejection hole located at a portion on an upstream side of the developing gap in the moving direction of the surface of the image bearing member, supplied with the developing liquid from outside, and a developing liquid recovery path, formed within the housing, forcibly recovering the surplus developing liquid in response to a suction force applied from the outside.

24 Claims, 11 Drawing Sheets

FIG. 8
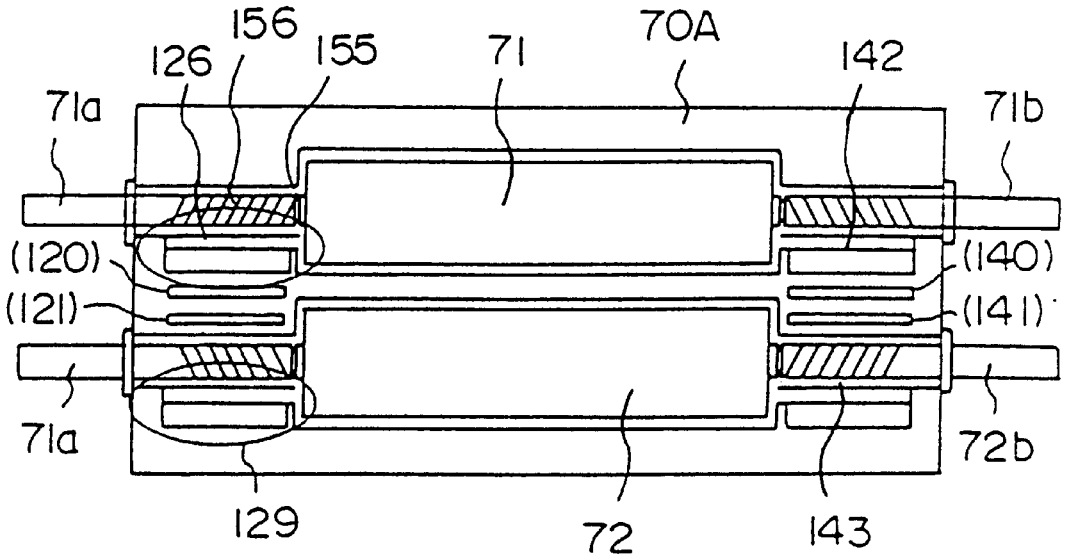
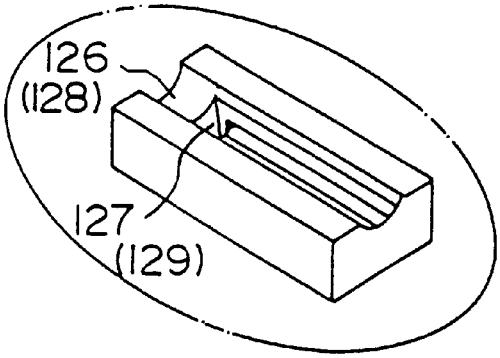
FIG. 8A

LIQUID DEVELOPING HEAD LIQUID DEVELOPING UNIT AND IMAGE FORMING APPARATUS

BACKGROUND OF THE INVENTION

The present invention generally relates to liquid developing heads, liquid developing units and image forming apparatuses, and more particularly to a liquid developing head and a liquid developing unit used in an electrophotography type printer which is provided with a photoconductive drum and to an image forming apparatus having such a liquid developing head and liquid developing unit.

The developing unit used in the electrophotography type printer which is provided with the photoconductive drum may be categorized into a dry type developing unit which uses a toner in the powder form, and a liquid developing unit which uses a developing liquid. The grain diameter of the powder toner is on the order of 5 to 10 $\mu$m, while the grain diameter of the toner within the developing liquid is on the order of 0.1 to 3 $\mu$m and small. Accordingly, when the liquid developing unit is used, it is possible to carry out the printing with a high resolution as compared to the case where the dry type developing unit is used. In addition, compared to the case where the dry type developing unit is used, it is possible to obtain a high color reproducibility of the toner when the liquid developing unit is used, and the liquid developing unit is suited for carrying out the printing with a high picture quality.

On the other hand, there are demands to reduce the size of the electrophotography type printer. In order to meet such demands, it is desirable that the set up location and the set up position of the liquid developing unit can be selected with a large degree of freedom.

A conventional liquid developing unit 10 has a construction shown in FIG. 1. As shown in FIG. 1, a developing roller 14 and a squeeze roller 15 are arranged side by side above a tank 12 which stores a developing liquid 11. The developing roller 14 supplies the developing liquid 11 on a surface of a photoconductive drum 13, and the squeeze roller 15 removes the developing liquid 11 adhered on the surface of the photoconductive drum 13.

With respect to the photoconductive drum 13, the position of the conventional liquid developing unit 10 is generally limited to a position under the photoconductive drum 13 so that the developing liquid 11 will not leak. In other words, the degree of freedom of the set up location and the set up position of the conventional liquid developing unit 10 was poor.

For this reason, in the electrophotography type printer which can carry out a color printing, a yellow (Y) liquid developing unit, a magenta (M) liquid developing unit, a cyan (C) liquid developing unit and a black (Bk) liquid developing unit are provided sequentially below the photoconductive drum as proposed in a Japanese Laid-Open Patent Application No.5-273861, for example. In this proposed electrophotography type printer, a liquid developing unit moving mechanism successively shifts each of the liquid developing units to a position immediately below the photoconductive drum. As a result, it was difficult to reduce the size of the electrophotography type printer.

SUMMARY OF THE INVENTION

Accordingly, it is a general object of the present invention to provide a novel and useful liquid developing head, liquid developing unit and image forming apparatus, in which the problems described above are eliminated.

Still another object of the present invention is to provide a liquid developing head which is arranged to confront a surface of an image bearing member via a developing gap and a squeeze gap and carries out a developing by use of a developing liquid, comprising a housing, a developing roller, supported by the housing, supplying the developing liquid to the developing gap by rotating so that a portion of the developing roller confronting the image bearing member moves in a direction which is the same as a moving direction of the surface of the image bearing member, a squeeze roller, supported by the housing and arranged on a downstream side of the developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member, a developing liquid supply path, formed within the housing and having an ejection hole located at a portion on an upstream side of the developing gap in the moving direction of the surface of the image bearing member, supplied with the developing liquid from outside, and a developing liquid recovery path, formed within the housing, forcibly recovering the surplus developing liquid in response to a suction force applied from the outside. According to the liquid developing head of the present invention, it is possible to effectively restrict the developing liquid from leaking to the outside regardless of the position of the liquid developing head, because the developing liquid supply path supplied with the developing liquid from the outside and the developing liquid recovery path applied with the suction force from the outside and forcibly recovering the surplus developing liquid are provided within the housing. As a result, it is possible to improve the degree of freedom with which the location and position of the liquid developing head are selected.

Still another object of the present invention is to provide a developing unit comprising a liquid developing head which is arranged to confront a surface of an image bearing member via a developing gap and a squeeze gap and carries out a developing by use of a developing liquid, the liquid developing head comprising a housing, a developing roller, supported by the housing, supplying the developing liquid to the developing gap by rotating so that a portion of the developing roller confronting the image bearing member moves in a direction which is the same as a moving direction of the surface of the image bearing member, a squeeze roller, supported by the housing and arranged on a downstream side of the developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member, a developing liquid supply path, formed within the housing and having an ejection hole located at a portion on an upstream side of the developing gap in the moving direction of the surface of the image bearing member, supplied with the developing liquid from outside, and a developing liquid recovery path, formed within the housing, forcibly recovering the surplus developing liquid in response to a suction force applied from the outside; a developing liquid tank; a supply pump supplying the developing liquid within the developing liquid tank to the liquid developing head; a suction pump returning the surplus developing liquid within the liquid developing head into the developing liquid tank; flexible hoses communicating the liquid developing head to the supply pump and the suction pump; and control means controlling operations of the supply pump and the suction pump, the control means starting the operation of the supply pump slightly after starting the operation of the suction pump at a start of the operation, and stopping the operation of the suction pump slightly after stopping the operation of the supply pump at an end of the operation. According to the liquid developing unit of the present invention, it is possible to freely and independently arrange the liquid developing head with respect to the supply pump and the suction pump because the liquid developing head is connected to the supply pump and the suction pump via the flexible hoses. In addition, since the control means starts the operation of the supply pump slightly after starting the operation of the suction pump at the start of the operation, and stops the operation of the suction pump slightly after stopping the operation of the supply pump at the end of the operation, it is possible to positively restrict the developing liquid from leaking outside the liquid developing head.

A further object of the present invention is to provide an image forming apparatus comprising a drum-shaped image bearing member having a surface; and a developing unit comprising a plurality of liquid developing head respectively arranged along a periphery of the image bearing member to confront the surface of the image bearing member via a developing gap and a squeeze gap and carries out a developing by use of a developing liquid, each of the liquid developing heads comprising a housing, a developing roller, supported by the housing, supplying the developing liquid to the developing gap by rotating so that a portion of the developing roller confronting the image bearing member moves in a direction which is the same as a moving direction of the surface of the image bearing member, a squeeze roller, supported by the housing and arranged on a downstream side of the developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member, a developing liquid supply path, formed within the housing and having an ejection hole located at a portion on an upstream side of the developing gap in the moving direction of the surface of the image bearing member, supplied with the developing liquid from outside, and a developing liquid recovery path, formed within the housing, forcibly recovering the surplus developing liquid in response to a suction force applied from the outside; a developing liquid tank; a supply pump supplying the developing liquid within the developing liquid tank to the liquid developing head; a suction pump returning the surplus developing liquid within the liquid developing head into the developing liquid tank; flexible hoses communicating the liquid developing head to the supply pump and the suction pump; and control means controlling operations of the supply pump and the suction pump, the control means starting the operation of the supply pump slightly after starting the operation of the suction pump at a start of the operation, and stopping the operation of the suction pump slightly after stopping the operation of the supply pump at an end of the operation. According to the image forming apparatus of the present invention, it is possible to reduce the size of the image forming apparatus when compared to the conventional image forming apparatus having the plurality of liquid developing heads arranged horizontally, because the plurality of liquid developing heads are arranged on the periphery of the drum-shaped image bearing member.

Other objects and further features of the present invention will be apparent from the following detailed description when read in conjunction with the accompanying drawings.

BRIEF DESCRIPTION OF THE DRAWINGS

FIG. 8 is a front view in vertical cross section cut along a vertical plane including a line VII—VII in FIG. 7;

DESCRIPTION OF THE PREFERRED EMBODIMENTS

Figure 1:
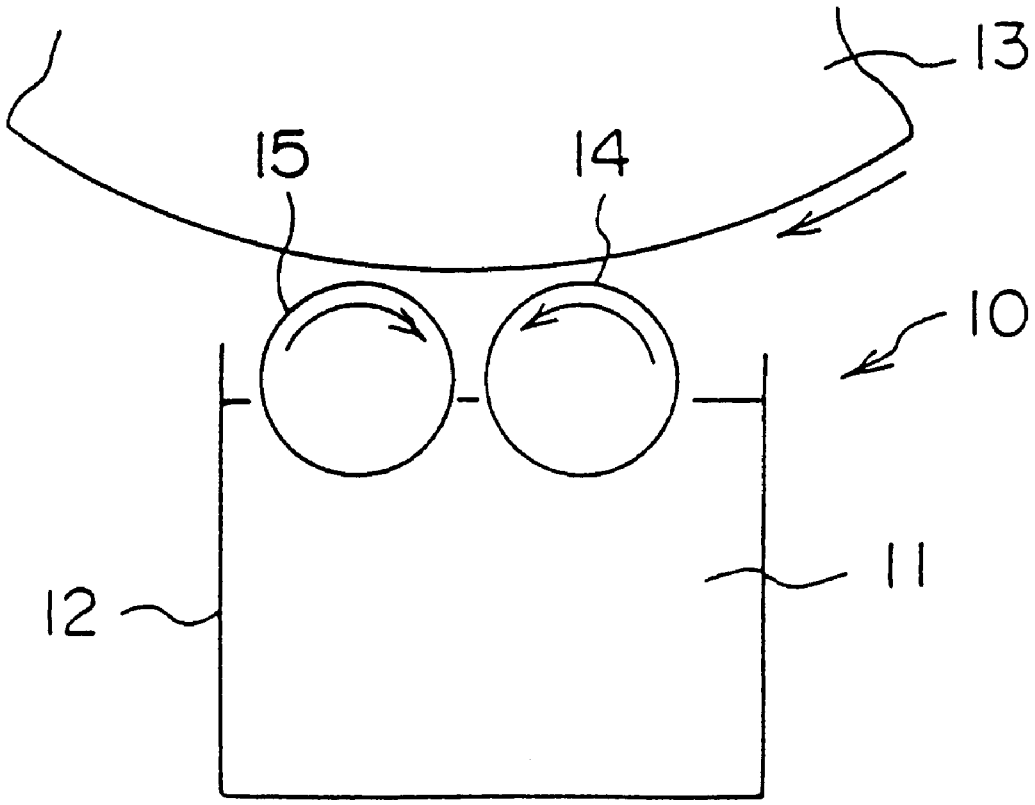
FIG. 1 PRIOR ART
FIG. 1 is a diagram showing a conventional liquid developing unit.
Figure 2:
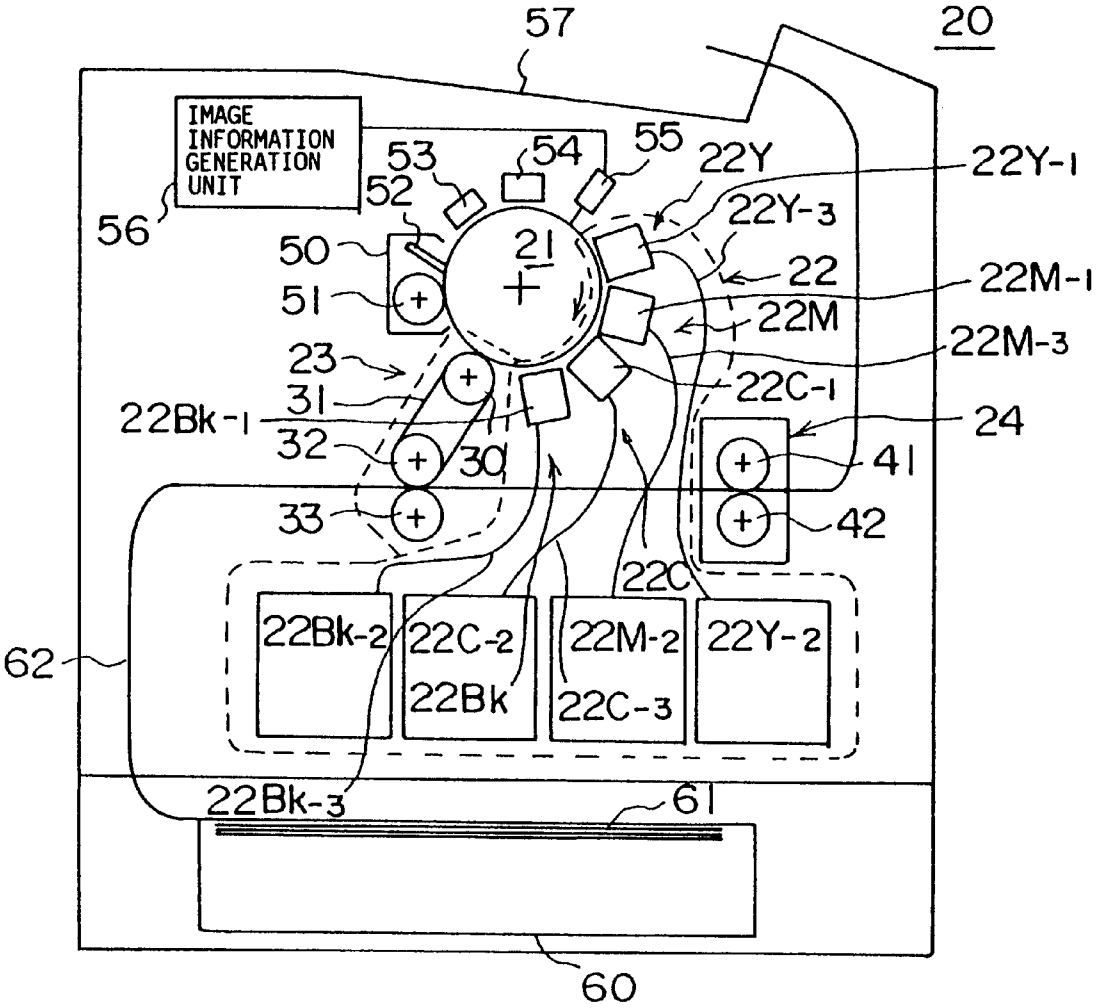
FIG. 2 is a diagram showing an embodiment of an image forming apparatus according to the present invention.

FIG. 2 shows an embodiment of an image forming apparatus according to the present invention. In this embodiment of the image forming apparatus, the present invention is applied to a color electrophotography type printer 20. This color electrophotography type printer 20 uses a liquid developing unit as the developing unit.

The color electrophotography type printer 20 includes a photoconductive drum 21 which is used as an image bearing member, a liquid developing unit 22, an intermediate transfer unit 23, a fixing unit 24 and the like.

The photoconductive drum 21 is provided at an approximate center portion of the color electrophotography type printer 20, and rotates clockwise.

The liquid developing unit 22 includes a yellow (Y) liquid developing unit 22Y, a magenta (M) liquid developing unit 22M, a cyan (C) liquid developing unit 22C, and a black (Bk) liquid developing unit 22Bk. The liquid developing unit 22Y generally includes a liquid developing head 22Y-1, a developing liquid tank 22Y-2 which stores a yellow developing liquid, and flexible hoses 22Y-3 which connect the developing liquid tank 22Y-2 and the liquid developing head 22Y-1. The liquid developing units 22M, 22C and 22Bk respectively include liquid developing heads 22M-1, 22C-1 and 22Bk-1, developing liquid tanks 22M-2, 22C-2 and 22Bk-2, and flexible hoses 22M-3, 22C-3 and 22Bk-3, where the developing liquid tank 22M-2 stores a magenta developing liquid, the developing liquid tank 22C-2 stores a cyan developing liquid and the developing liquid tank 22Bk-2 stores a black developing liquid.

The liquid developing heads 22Y-1, 22M-1, 22C-1 and 22Bk-1 are arranged close together in this sequence along the rotating direction of the photoconductive drum 21, adjacent to the peripheral surface of the photoconductive drum 21. The liquid developing head 22Y-1 takes a position facing obliquely downwards, the liquid developing head 22M-1 takes a position facing approximately sidewards, the liquid developing head 22C-1 takes a position facing obliquely upwards, and the liquid developing head 22Bk-1 takes a position facing approximately upwards. The reason why the set up location and the set up position of the liquid developing heads 22Y-1, 22M-1, 22C-1 and 22Bk-1 can be selected with a high degree of freedom in this manner will be described later in the specification.

The developing liquid tanks 22Y-2, 22M-2, 22C-2 and 22Bk-2 are arranged side by side at a position near the bottom of the color electrophotography type printer 20 (that is, a position having little relation to the photoconductive drum 12).

The size of the color electrophotography type printer 20 is small compared to that of the conventional color electrophotography type printer because the color electrophotography type printer 20 has the construction described above wherein the liquid developing heads and the developing liquid tanks of he liquid developing unit 22 are independently provided and all of the liquid developing heads are arranged around the periphery of the photoconductive drum 21.

The intermediate transfer unit 23 includes a primary transfer roller 30, a belt-shaped intermediate transfer member 31, a secondary transfer roller 32, and a backup roller 33. The belt-shaped intermediate transfer member 31 is provided across the primary transfer roller 30 and the secondary transfer roller 32. The primary transfer roller 30 is arranged at a position on the immediate downstream side of the liquid developing head 22Bk-1 in the rotating direction of the photoconductive drum 21, and pushes the intermediate transfer member 31 against the peripheral surface of the photoconductive drum 21.

The fixing unit 24 is arranged at a position on the downstream side of the intermediate transfer unit 23, and includes a heat roller 40 and a backup roller 41.

In the periphery of the photoconductive drum 21 between the primary transfer roller 30 and the liquid developing head 22Y-1, a cleaning unit 50 (including a cleaning roller 51 and a cleaning blade 52), a discharger 53, a charger 54 and a laser scanner 55 are arranged in this sequence from the side of the primary transfer roller 33 in the rotating direction of the photoconductive drum 21. The laser scanner 55 operates in response to image information received from an image information generating unit 56.

The color electrophotography type printer 20 operates with one cycle generally made up of the following five stages.

For every stage, the photoconductive drum 21 makes one revolution, and the intermediate transfer unit 23, the discharger 53 and the charger 54 operate.

First Stage

The image information generating unit 56 outputs yellow image information, and the yellow liquid developing unit 22Y operates. A yellow latent image is formed on the photoconductive drum 21, and this latent image is developed by the liquid developing unit 22, thereby forming a yellow image on the photoconductive drum 21. The yellow image on the photoconductive drum 21 is transferred onto the belt-shaped intermediate transfer member 31 of the intermediate transfer unit 23.

Second Stage

The image information generating unit 56 outputs magenta image information, and the magenta liquid developing unit 22G operates. A magenta latent image is formed on the photoconductive drum 21, and this latent image is developed by the liquid developing unit 22, thereby forming a magenta image on the photoconductive drum 21. The magenta image on the photoconductive drum 21 is transferred onto the belt-shaped intermediate transfer member 31 of the intermediate transfer unit 23, in an overlapping manner on the yellow image which is already transferred onto the belt-shaped intermediate transfer member 31.

Third Stage

The image information generating unit 56 outputs cyan image information, and the cyan liquid developing unit 22C operates. A cyan latent image is formed on the photoconductive drum 21, and this latent image is developed by the liquid developing unit 22, thereby forming a cyan image on the photoconductive drum 21. The cyan image on the photoconductive drum 21 is transferred onto the belt-shaped intermediate transfer member 31 of the intermediate transfer unit 23, in an overlapping manner on the yellow and magenta images which are already transferred onto the belt-shaped intermediate transfer member 31.

Fourth Stage

The image information generating unit 56 outputs black image information, and the black liquid developing unit 22Bk operates. A black latent image is formed on the photoconductive drum 21, and this latent image is developed by the liquid developing unit 22, thereby forming a black image on the photoconductive drum 21. The black image on the photoconductive drum 21 is transferred onto the belt-shaped intermediate transfer member 31 of the intermediate transfer unit 23, in an overlapping manner on the yellow, magenta and cyan images which are already transferred onto the belt-shaped intermediate transfer member 31.

Fifth Stage

Paper 61 is supplied from a paper cassette 61, and the paper 61 is transported along a predetermined path 62 which has an approximate S-shape. The image on the intermediate transfer member 31 is transferred onto the paper 61 as the paper 61 is transported while being pushed against the intermediate transfer member 31 by the backup roller 33. The image transferred onto the paper 61 is fixed on the paper 61 by the fixing unit 24 as the paper 61 passes the fixing unit 24, and the color printing with respect to the paper 61 is completed. The paper 61 which is subjected to the color printing is supplied to a stacker 57 which is provided at the upper portion of the color electrophotography type printer 20, with the printed image facing down.

Next, a description will be given of the yellow (Y) liquid developing unit 22Y.

Figure 3:
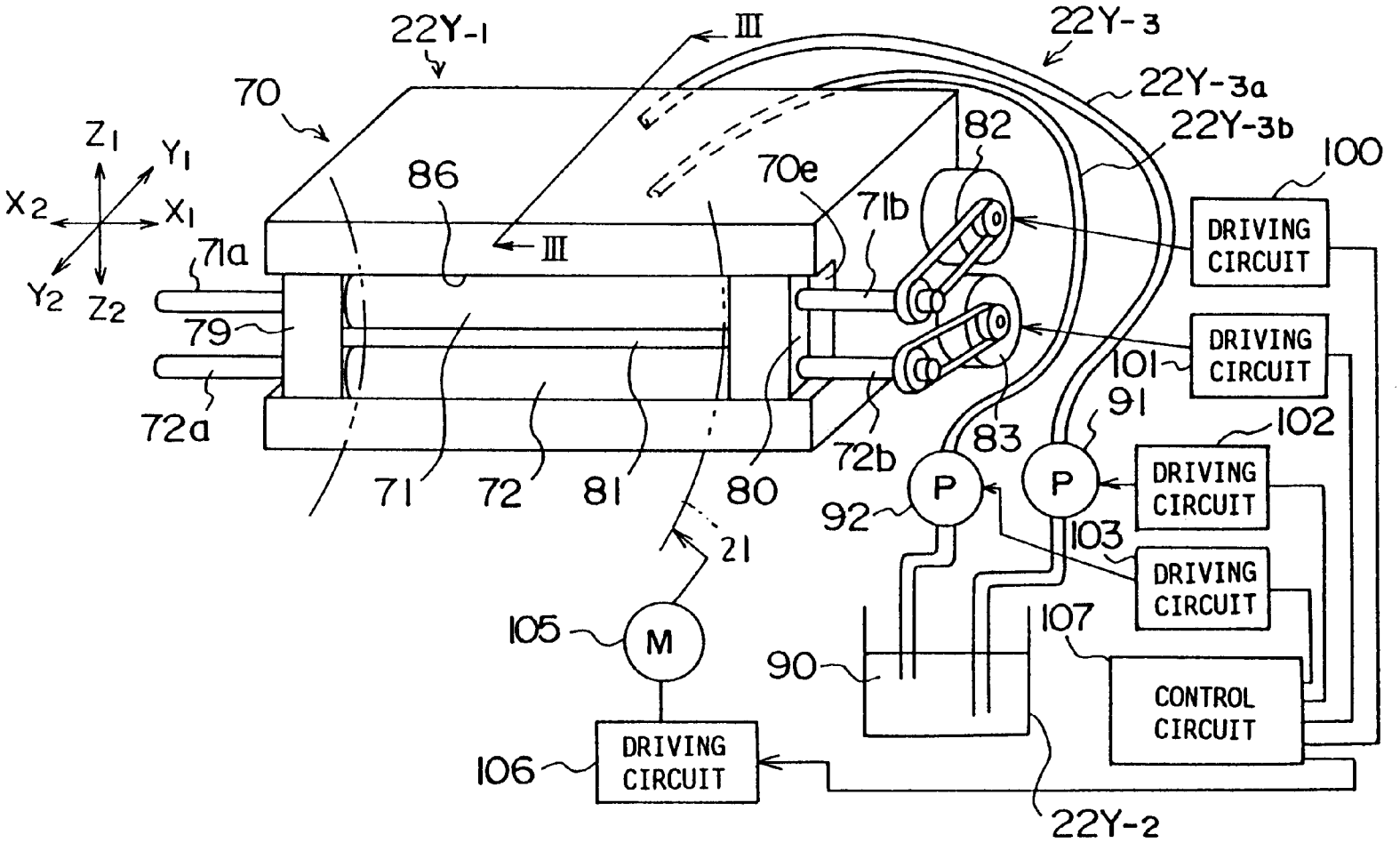
FIG. 3 is a diagram showing an embodiment of a liquid developing unit according to the present invention.

FIG. 3 shows an embodiment of the liquid developing head. In this embodiment of the liquid developing head, the present invention is applied to the yellow liquid developing unit 22Y. The yellow liquid developing unit 22Y has a size which can cope with a paper having a size up to A3 size. For the sake of convenience, FIG. 3 shows the yellow liquid developing unit 22Y with its length shortened, and the same holds true for the other figures. The yellow liquid developing unit 22Y generally includes the liquid developing head 22Y-1, the developing liquid tank 22Y-2 and the flexible hoses 22Y-3.

Figure 4:
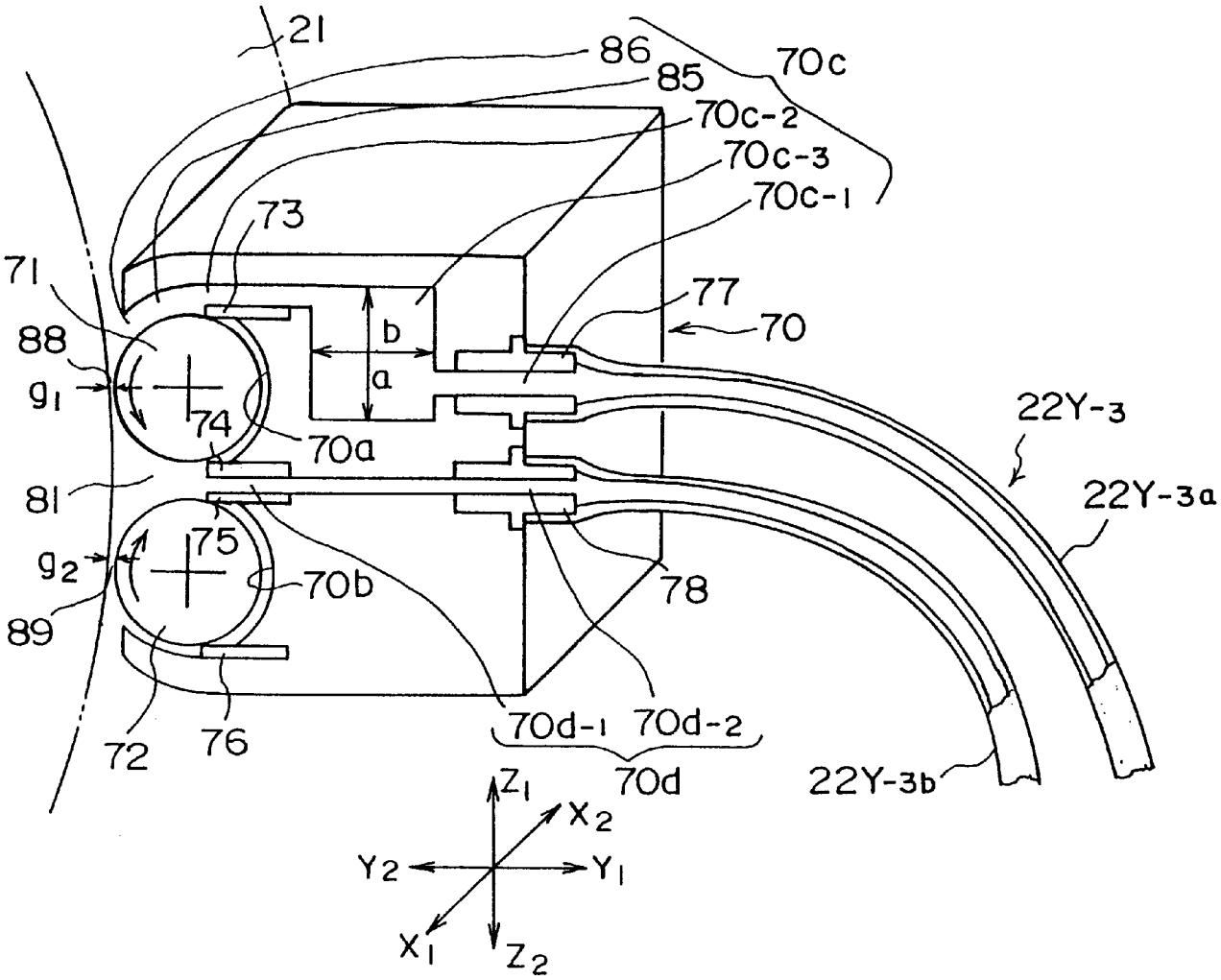
FIG. 4 is a diagram showing an embodiment of a liquid developing head according to the present invention.

FIG. 4 shows an embodiment of the liquid developing head. In this embodiment of the liquid developing head, the present invention is applied to the liquid developing head 22Y-1 of the yellow (Y) liquid developing unit 22Y. As shown in FIG. 4, the liquid developing head 22Y-1 generally includes a housing 70, a developing roller 71 and a squeeze roller 72. FIG. 4 is a cross sectional view taken along a vertical plane including a line III—III in FIG. 3. In FIGS. 3 and 4, X1 and X2 denote the width direction, Y1 and Y2 denote the depth direction, and Z1 and Z2 denote the height direction.

A developing roller accommodating part 70*a* and a squeeze roller accommodating part 70*b* are formed on the front side of the housing 70. The developing roller accommodating part 70*a* is positioned towards the direction Z1 from the center along the height direction, has a concave shape, and is long in the directions X1 and X2. The squeeze roller accommodating part 70*b* is positioned towards the direction Z2 from the center along the height direction, has a concave shape, and is long in the direction X1 and X2. Blades 73, 74, 75 and 76 made of an urethane resin are fixed on the housing 70 in a state where the blades 73 and 74 project into the developing roller accommodating part 70*a* and the blades 75 and 76 project into the squeeze roller accommodating part 70*b*.

In addition, a developing liquid supply path 70*c* and a surplus developing liquid recovery path 70*d* are formed within the housing 70 so as to penetrate the housing 70 in the depth direction.

The developing liquid supply path 70*c* starts from a supply hole 70*c*-1 provided in the rear surface of the housing 70, and extends in the direction Y2, to reach a hole 70*c*-2 which is provided at a position closer to the upper end of the developing roller accommodating part 70*a*. Further, the developing liquid supply path 70*c* continues as a flat space 85, and an ejection hole 86 is provided at the terminal end. The developing liquid supply path 70*c* has a sealed structure.

The flat space 85 is the gap formed between a portion of the peripheral surface of the developing roller 71 closer to the upstream side along the rotating direction of the photoconductive drum 21 and a portion of the inner wall surface of the developing roller accommodating part 70*a* closer to the front surface of the housing 70. The ejection hole 86 is formed at the end of the flat space 85. As shown in FIG. 3, when viewed from the front surface of the liquid developing head 22Y-1, the ejection hole 86 is formed between the housing 70 and a portion of the peripheral surface of the developing roller 71 on the upstream side along the rotating direction of the photoconductive drum 21, and has an elongated shape which is elongated in the directions X1 and X2. The ejection hole 86 is formed between the peripheral surface of the developing roller 71 and the front end of the housing 70, and is positioned on the upstream side of a developing gap 88 which will be described later along the rotating direction of the photoconductive drum 21.

In addition, the developing liquid supply path 70*c* includes at an intermediate portion thereof a buffer chamber 70*c*-3 which is elongated in the directions X1 and X2 and has a height a and a depth b. A plug 77 is fixed into the supply hole 70*c*-1.

The surplus developing liquid recovery path 70*d* starts from a recovery hole 70*d*-1 in the front surface side of the housing 70 between the developing roller accommodating part 70*a* and the squeeze roller accommodating part 70*b* (between the blades 74 and 75), extends in the direction Y1, and terminates at a hole 70*d*-2 in the rear surface of the housing 70. The surplus developing liquid recovery path 70*d* has a sealed structure. A plug 78 is fixed into the hole 70*d*-2.

The developing roller 71 and the squeeze roller 72 respectively have a diameter of 12 mm and are made of aluminum. Narrow shafts 71*a* and 71*b* are provided on respective ends of the developing roller 71, and narrow shafts 72*a* and 72*b* are provided on respective ends of the developing roller 72. The developing roller 71 and the squeeze roller 72 are rotatably supported in a state where the shafts 71*a*, 71*b*, 72*b* and 72*b* are supported by bearing blocks 79 and 80. The bearing blocks 79 and 80 fit into a recess 70*e* which is provided on both sides at the front surface of the housing 70. The developing roller 71 is accommodated within the developing roller accommodating part 70*a*. The squeeze roller 72 is accommodated within the squeeze roller accommodating part 70*b*. The blades 73 and 74 make contact with the developing roller 71. The blades 75 and 76 make contact with the squeeze roller 72.

A developing liquid accumulation part 81 which is elongated in the directions X1 and X2 is formed between the developing roller 71 and the squeeze roller 72.

In addition, motors 82 and 83 are provided on the side surface of the housing 70 facing the direction X1, and the developing roller 71 and the squeeze roller 72 are rotated independently by these motors 82 and 83.

A hose 22Y-3*a* of the flexible hoses 22Y-3 is connected to the plug 77, and a hose 22Y-3*b* of the flexible hoses 22Y-3 is connected to the plug 78.

As shown in FIG. 4, the liquid developing head 22Y-1 having the above described construction confronts the photoconductive drum 21. Due to a gap roller (not shown), the developing gap 88 is formed between the developing roller 71 and the photoconductive drum 21, and a squeeze gap 89 is formed between the squeeze roller 72 and the photoconductive drum 21. The developing gap 88 has a size g1 of 50 to 500 $\mu$m, and the squeeze gap 89 has a size of 50 to 100 $\mu$m. For the sake of convenience, FIG. 4 shows the liquid developing head 22Y-1 in a horizontal position.

As shown in FIG. 3, the developing liquid tank 22Y-2 stores a yellow developing liquid 90. A supply pump 91 for supplying the yellow developing liquid 90 within the developing liquid tank 22Y-2, and a suction pump 92 for sucking the surplus developing liquid within the liquid developing head 22Y-1 and forcibly returning the surplus developing liquid into the developing liquid tank 22Y-2, are provided with respect to the developing liquid tank 22Y-2. The other end of the hose 22Y-3 a is connected to the supply pump 91, and the other end of the hose 22Y-3*b* is connected to the suction pump 92. For example, the yellow developing liquid 90 includes a carrier liquid such as Isopar L manufactured by Exxon Chemicals, and has a toner concentration of 1 to 10 weight %.

Driving circuits 100 and 101 are provided with respect to the motors 82 and 83, and driving circuits 102 and 103 are provided with respect to the pumps 91 and 92. In addition, a driving circuit 106 is provided with respect to a motor 105 which rotates the photoconductive drum 21. The driving circuits 100, 101, 102, 103 and 106 are controlled by a control circuit 107 which is provided as a control means. The control circuit 107 controls the starting order and the like of the operation.

Figure 5:
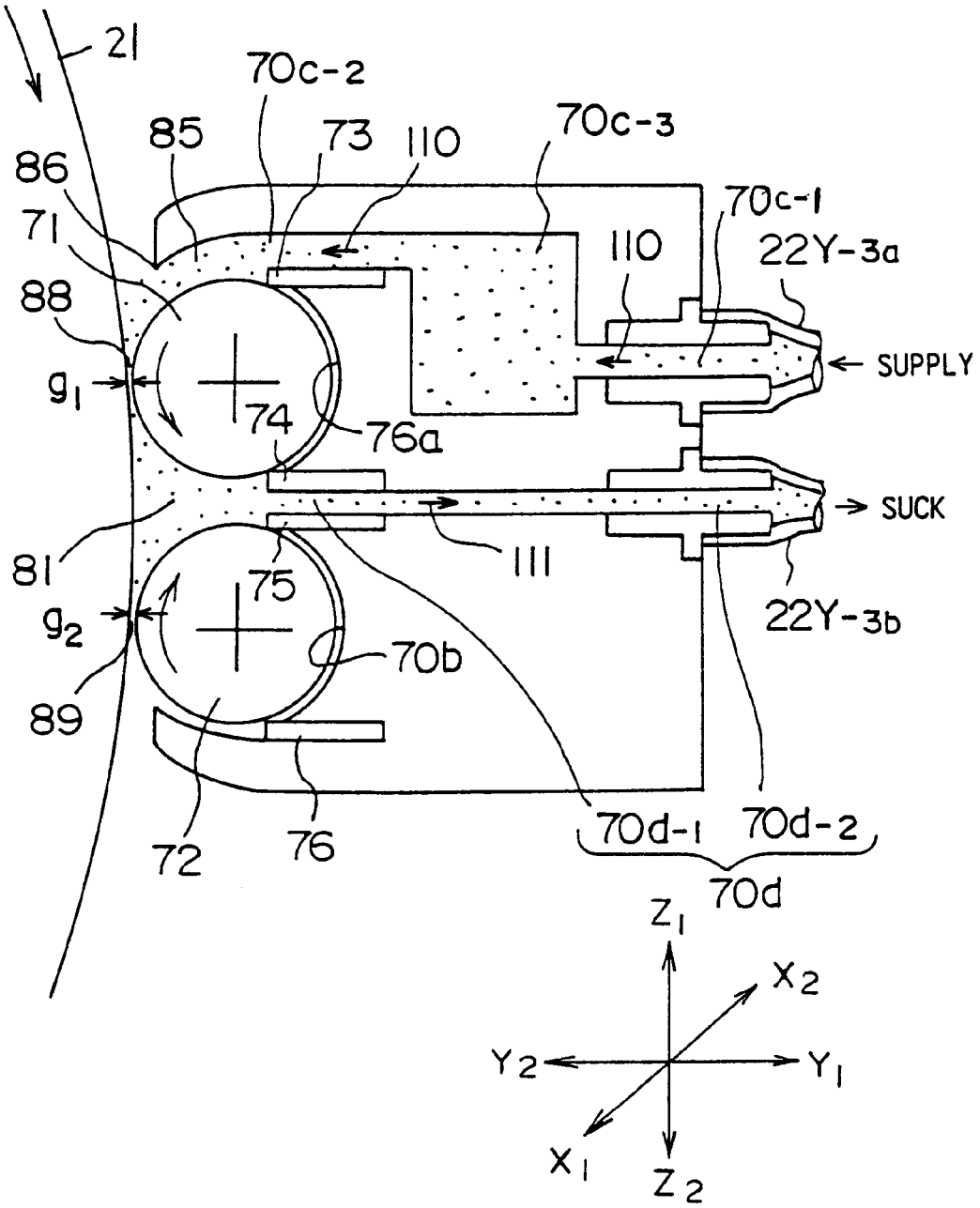
FIG. 5 is a diagram for explaining the operation of the liquid developing head during a developing operation.

Next, a description will be given of the operation of the liquid developing unit 22Y having the above described construction, by referring to FIGS. 5 and 6(A) through 6(E). FIG. 5 is a diagram for explaining the operation of the liquid developing head 22Y-1 during a developing operation, and FIGS. 6(A) through 6(E) are time charts for explaining the operation of the liquid developing unit 22Y.

The operation of the liquid developing unit 22Y will be described separately with respect to the start of the first stage of the color printing operation, during the operation, and the end of the operation.

(1) During Operation

In this state, all of the driving circuits 100, 101, 102, 103 and 106 are controlled to the operating states by the control circuit 107. As shown in FIG. 5 and FIGS. 6(A), 6(B) and 6(C), the photoconductive drum 21 is rotated clockwise by the motor 105 at a peripheral speed v1, the developing roller 71 is rotated counterclockwise by the motor 82 at a peripheral speed v2 which has a peripheral speed ratio of 1 to 5 with respect to the peripheral speed v1 of the photoconductive drum 21, and the squeeze roller 72 is rotated clockwise by the motor 83 at a peripheral speed v3 which has a peripheral speed ratio of 1 to 5 with respect to the peripheral speed v1 of the photoconductive drum 21.

The developing roller 71 rotates so that a portion of the developing roller 71 confronting the photoconductive drum 21 moves in a direction which is the same as a moving direction of the surface of the photoconductive drum 21. The squeeze roller 72 rotates so that a portion of the squeeze roller 72 confronting the photoconductive drum 21 moves in a direction which is opposite to the moving direction of the surface of the photoconductive drum 21. The squeeze roller 72 is arranged on the downstream side of the developing roller 71 in the moving direction of the surface of the photoconductive drum 21.

Figure 6:
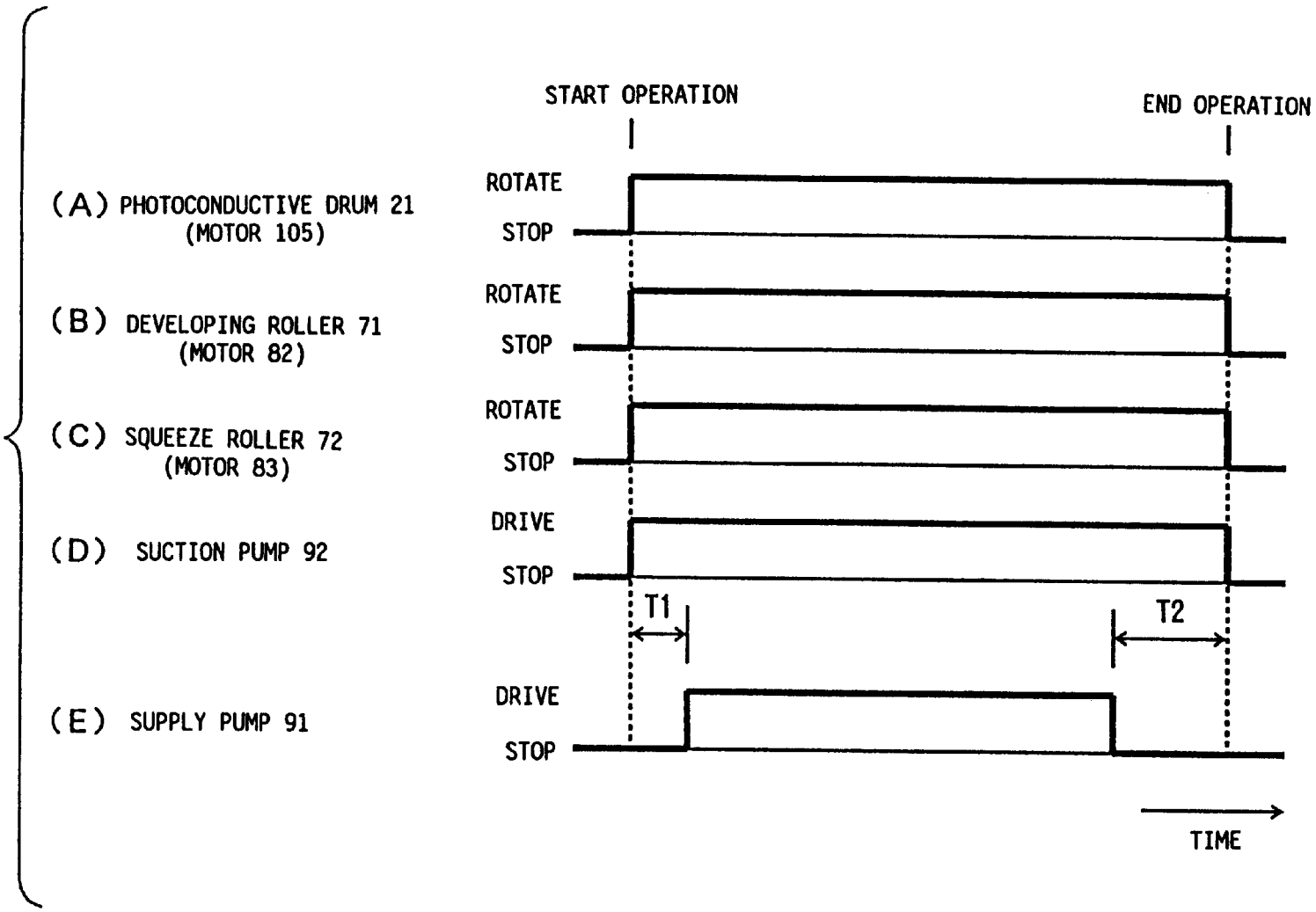
FIGS. 6(A) through 6(E) are time charts for explaining the operation of the liquid developing unit.

In addition, the supply pump 91 is driven as shown in FIG. 6(E), and the suction pump 92 is driven as shown in FIG. 6(D).

As indicated by an arrow 110 in FIG. 5, the supply pump 91 continuously supplies the yellow developing liquid 90 within the developing liquid tank 22Y-2 to the developing liquid supply path 70*c* within the housing 70 of the liquid developing head 22Y-1 via the hose 22Y-3*a*. For example, if the photoconductive drum 21 has a size corresponding to the A3 size of the paper and rotates at the peripheral speed of 180 mm/sec, the yellow developing liquid 90 is ejected from the ejection hole 86, that is, from the upstream side of the developing roller 71, at a rate of approximately 1 to 10 liters per minute (which is the amount necessary for the developing). The ejected yellow developing liquid 90 is transported by the photoconductive drum 21 and the developing roller 71 which rotates counterclockwise, and is uniformly supplied throughout the entire length (corresponding to the length of the photoconductive drum 21) of the developing gap 88. As a result, the latent image on the photoconductive drum 21 is developed.

The surplus yellow developing liquid adhered on the portion of the surface portion of the photoconductive drum 21 which passes the developing gap 88 is scraped off at the squeeze gap 89 by the squeeze roller 72, and is returned to the developing liquid accumulation part 81.

The surplus yellow developing liquid which is returned to the developing liquid accumulation part 81 is sucked by the suction pump 92 which continues to be driven, from the recovery hole 70*d*-1 via the surplus developing liquid recovery path 70*d* as indicated by an arrow 111, and is forcibly recovered.

As described above, all of the yellow developing liquid 90 ejected from the ejection hole 86 is transported to the developing gap 88 by the photoconductive drum 21 and the developing roller 71, and a portion of the yellow developing liquid 90 ejected from the ejection hole 86 is prevented from leaking outside the liquid developing head 22Y-1. The surplus yellow developing liquid adhered on the surface portion of the photoconductive drum 21 which passes the developing gap 88 is returned to the developing liquid accumulation part 81 by the squeeze roller 72, and the surplus yellow developing liquid will not leak outside the liquid developing head 22Y-1. The surplus yellow developing liquid which is returned to the developing liquid accumulation part 81 is sucked by the suction pump 92 and is forcibly recovered, so that the surplus yellow developing liquid which is returned to the developing liquid accumulation part 81 will not leak outside the liquid developing head 22Y-1. Accordingly, although the liquid developing head 22Y-1 takes a horizontal position, the yellow developing liquid will not leak outside the liquid developing head 22Y-1.

The surface of the developing roller 71 is cleaned by the blades 73 and 74. The surface of the squeeze roller 72 is cleaned by the blades 75 and 76. In addition, the yellow developing liquid adhered on the developing roller 71 is scraped off by the blade 74 and is returned to the developing liquid accumulation part 81. The yellow developing liquid adhered on the squeeze roller 72 is scraped off by the blade 75 and is returned to the developing liquid accumulation part 81. The blade 73 restricts the yellow developing liquid from the hole 70*c*-2 which enters the flat space 85 from going around to the back side of the developing roller 71.

On the other hand, the yellow developing liquid 90 which is supplied to the developing liquid supply path 70*c* by the supply pump 91 enters the buffer chamber 70*c*-3 and then moves towards the ejection hole 86. For this reason, even if the flow rate of the yellow developing liquid supplied to the developing liquid supply path 70*c* changes due to the effects of vibration or the like, this change in the flow rate is absorbed by the buffer chamber 70*c*-3, and the amount of the yellow developing liquid ejected from the ejection hole 86 is maintained constant. In other words, the amount of the yellow developing liquid ejected from the ejection hole 86 is prevented from becoming excessively large not even temporarily. Therefore, the yellow developing liquid ejected from the ejection hole 86 is more positively prevented from leaking outside the liquid developing head 22Y-1.

(2) At the Start of Operation

The control circuit 107 controls the order with which the operation is started. All of the driving circuits 100, 101 and 106 are operated by the control circuit 107, and as shown in FIGS. 6(A), 6(B) and 6(C), the photoconductive drum 21, the developing roller 71 and the squeeze roller 72 start to rotate simultaneously. In addition, the driving circuit 103 is operated first by the control circuit 107, and the driving circuit 102 is operated by the control circuit 107 after a slight delay. As shown in FIGS. 6(D) and 6(E), the suction pump 92 starts to operate simultaneously as the rotation of the photoconductive drum 21, the developing roller 71 and the squeeze roller 72, and the supply pump 91 starts to operate after a delay time T1. Accordingly, the supply of the yellow developing liquid is started in a state where the photoconductive drum 21, the developing roller 71 and the squeeze roller 72 are rotating and the suction pump 92 is operating. As a result, the yellow developing liquid ejected from the ejection hole 86 quickly moves towards the developing gap 88, and the yellow developing liquid ejected from the ejection hole 86 will not leak outside the liquid developing head 22Y-1.

(3) At the End of Operation

The control circuit 107 controls the order with which the operation is stopped. As may be seen from FIGS. 6(A)

through 6(E), the control circuit 107 first stops the operation of the supply pump 91, then stops the operation of the suction pump 92 after a delay time T2, and stops the rotation of the photoconductive drum 21, the developing roller 71 and the squeeze roller 72.

Accordingly, the liquid developing head 22Y-1 ends the operation thereof in a state where the ejection of the yellow developing liquid from the ejection hole 86 is stopped, and the surplus yellow developing liquid returned to the developing liquid accumulation part 81 is sucked by the suction pump 92 and is forcibly recovered so that the yellow developing liquid is recovered from the front surface side of the liquid developing head 22Y-1. For this reason, the yellow developing liquid will not leak outside the liquid developing head 22Y-1.

In FIG. 2, the liquid developing heads 22M-1, 22C-1 and 22 Bk-1 and the liquid developing units 22M, 22C and 22Bk respectively have the same construction as the liquid developing head 22Y-1 and the liquid developing unit 22Y described above, and operate similarly to the liquid developing head 22Y-1 and the liquid developing unit 22Y described above.

Figure 7:
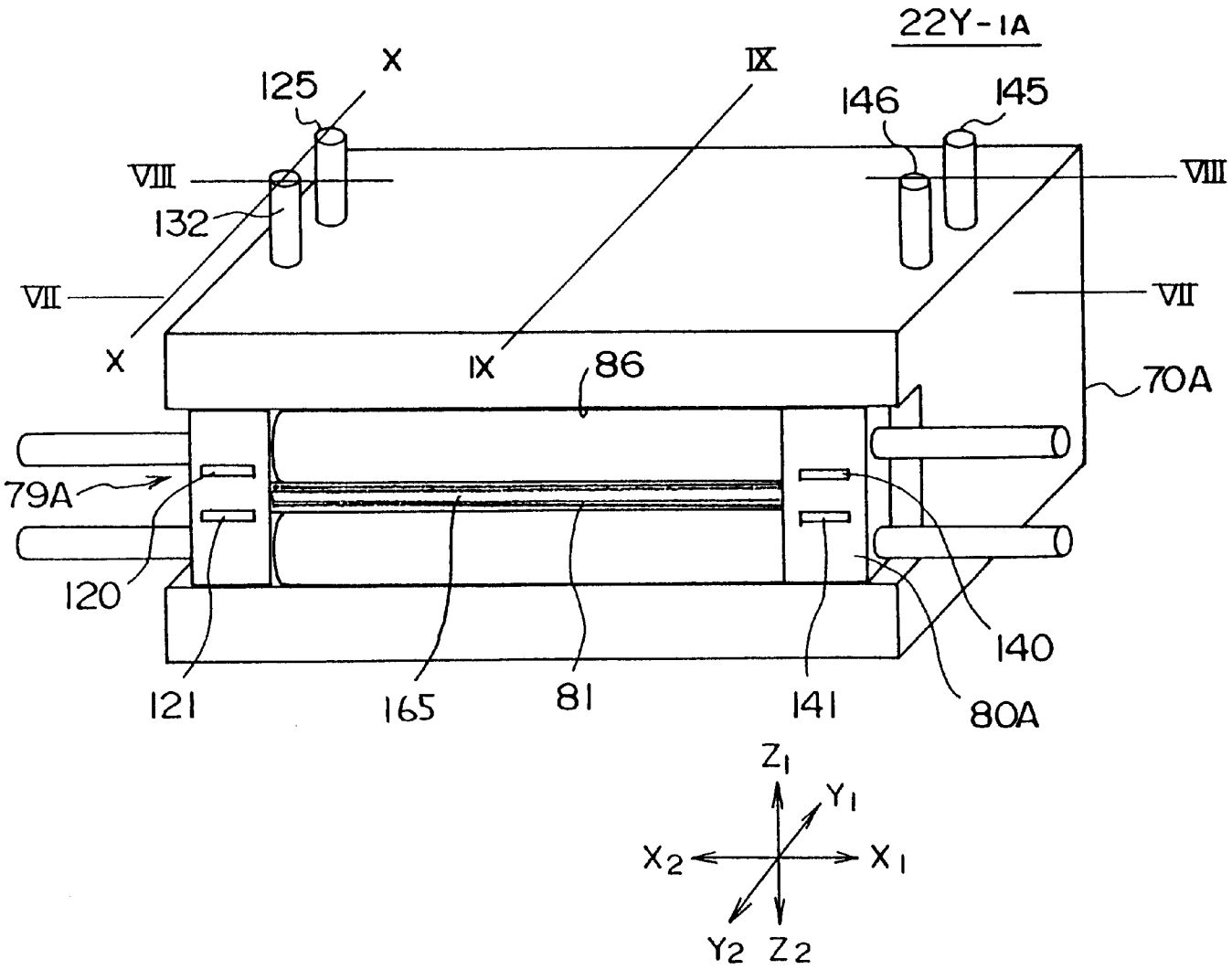
FIG. 7 is a diagram showing another embodiment of the liquid developing head according to the present invention.
Figure 9:
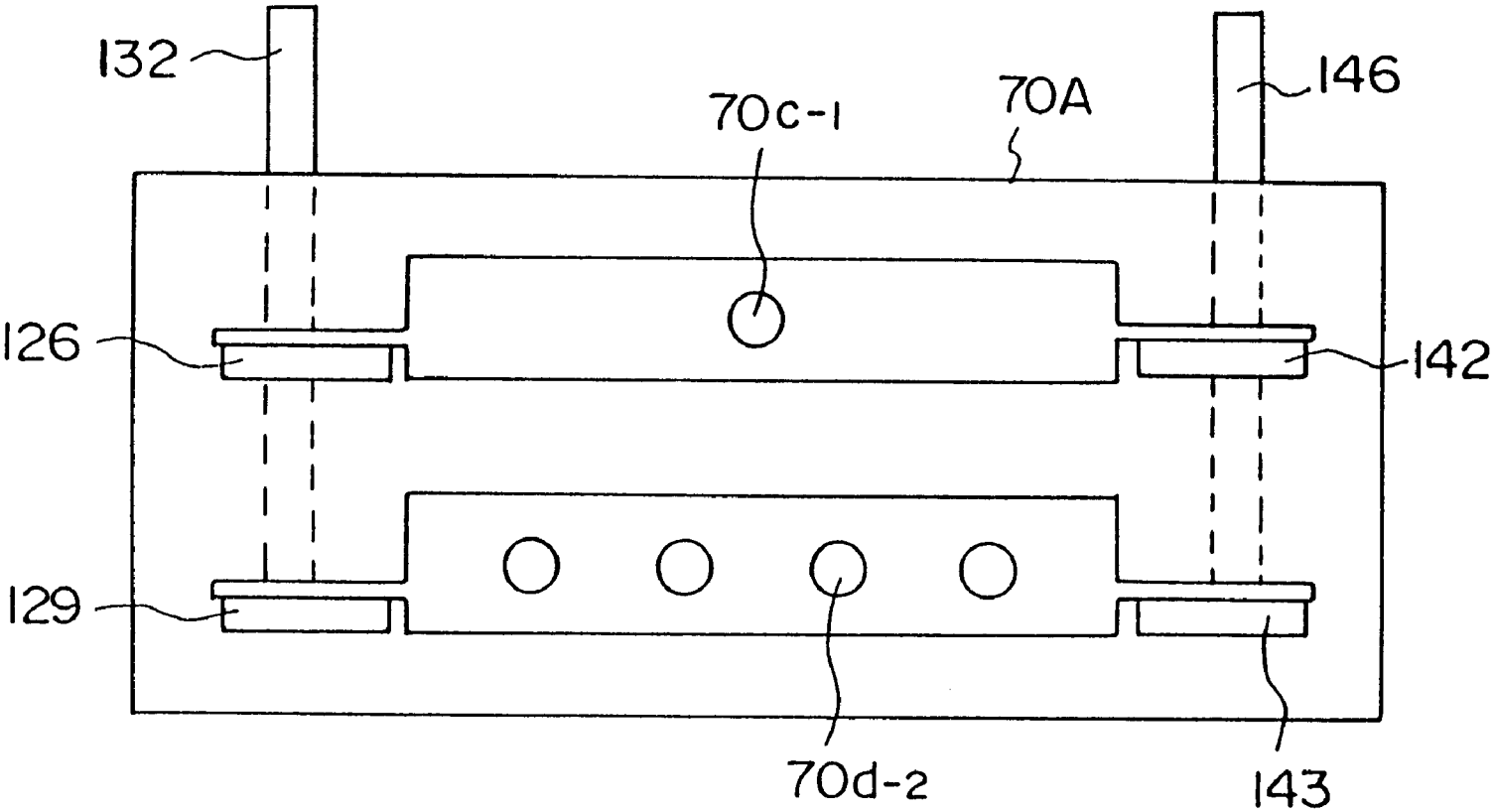
FIG. 9 is a front view in vertical cross section cut along a vertical plane including a line VIII—VIII in FIG. 7.
Figure 10:
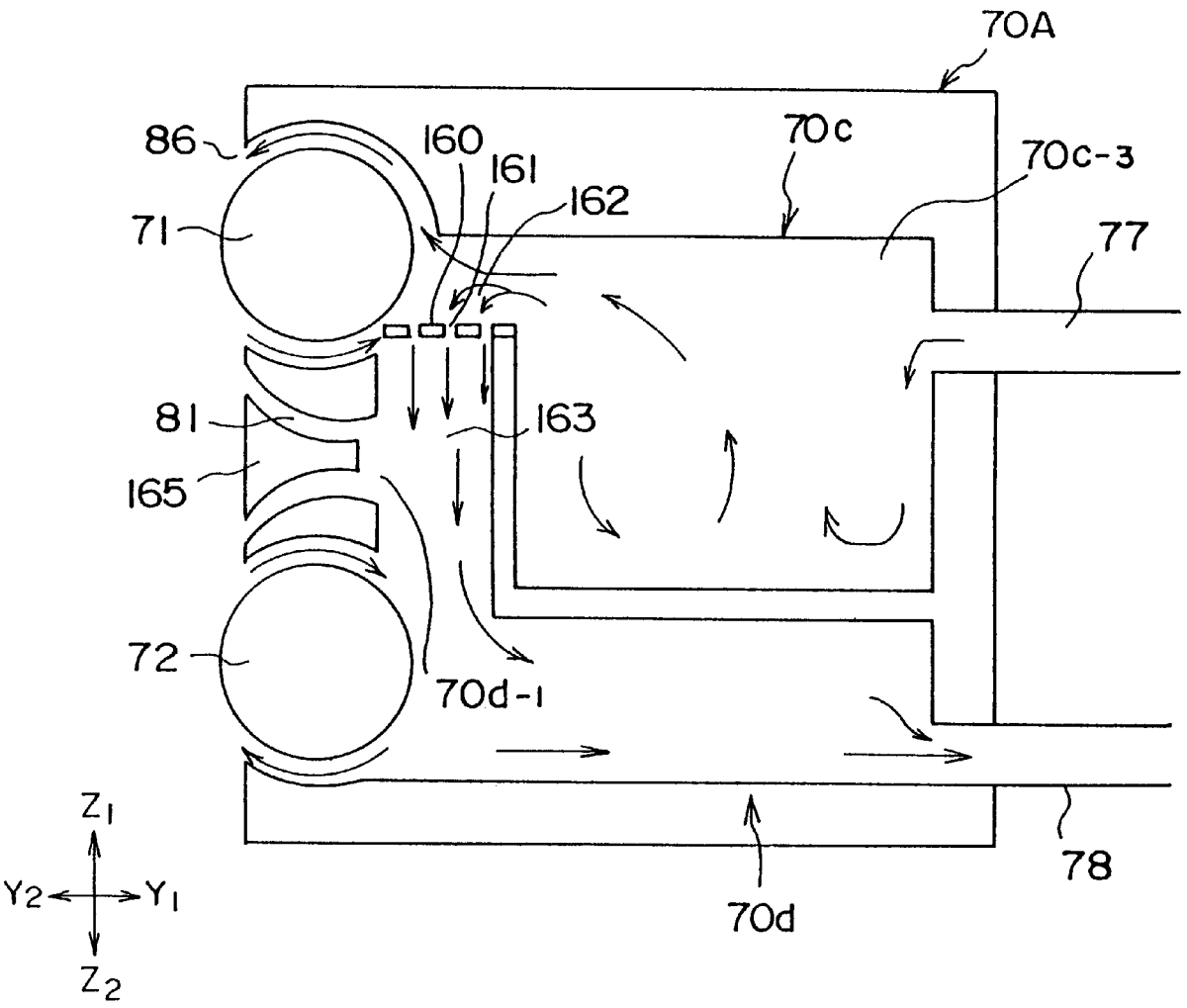
FIG. 10 is a front view in vertical cross section cut along a vertical plane including a line IX—IX in FIG. 7.

Next, a description will be given of a liquid developing head 22Y-1A in another embodiment of the present invention, by referring to FIGS. 7 through 11. FIG. 7 is a diagram showing another embodiment of the liquid developing head according to the present invention. FIG. 8 is a front view in vertical cross section cut along a vertical plane including a line VII—VII in FIG. 7, and FIG. 9 is a front view in vertical cross section cut along a vertical plane including a line VIII—VIII in FIG. 7. FIG. 10 is a front view in vertical cross section cut along a vertical plane including a line IX—IX in FIG. 7, and FIG. 11 is a front view in vertical cross section cut along a line X—X in FIG. 7.

Compared to the liquid developing head 22Y-1 shown in FIGS. 3 and 4, the liquid developing head 22Y-1A is constructed to additionally include a surplus developing liquid recovery hole. In FIGS. 7 through 11, those parts which are the same as those corresponding parts in FIGS. 3 and 4 are designated by the same reference numerals, and a description thereof will be omitted.

Figure 11:
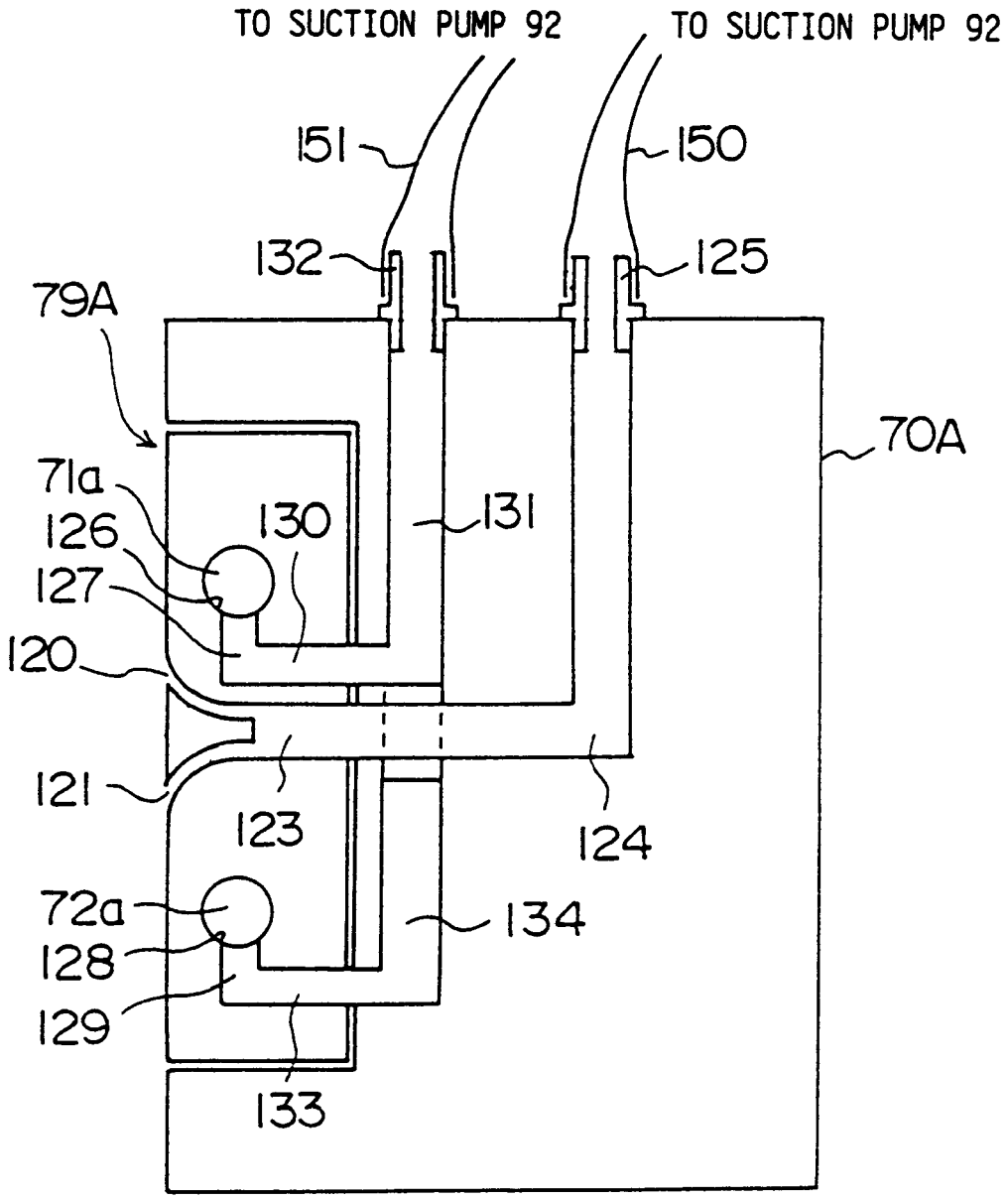
FIG. 11 is a front view in vertical cross section cut along a line X—X in FIG. 7.

As shown in FIGS. 7, 8 and 11, two slit-shaped side recovery holes 120 and 121 which are elongated in the directions X1 and X2 are formed in the front surface of a bearing block 79A. The side recovery holes 120 and 121 communicate to a plug 125 on the top surface of a housing 70 A via a path 123 within the bearing block 79A and a path 124 within the housing 70 A. One end of a flexible hose 150 is connected to the plug 125, and the other end of the flexible hose 150 is connected to the suction pump 92.

In addition, as shown in FIGS. 8, 9 and 11, a surplus developing liquid accumulation part 127 is formed below and along an upper bearing part 126 within the bearing block 79A. A surplus developing liquid accumulation part 129 is formed below and along a lower bearing part 128 within the bearing block 79A. The surplus developing liquid accumulation part 127 communicates to a plug 132 on the top surface of the housing 70A via a path 130 within the bearing block 79A and a path 131 within the housing 70A. The surplus developing liquid accumulation part 129 communicates to the path 131 via a path within the bearing block 79A and a path 134 within the housing 70A. One end of a flexible hose 151 is connected to the plug 132, and the other end of the flexible hose 151 is connected to the suction pump 92.

Another bearing block 80 A has a structure identical to that of the bearing block 79 A described above, and is formed with side recovery holes 140 and 141, surplus developing liquid accumulation parts 412 and 144 and paths. In addition, a plug 145 which communicates to the side recovery holes 140 and 141, and a plug 146 which communicates to the surplus developing liquid accumulation parts 142 and 144 are provided on the top surface of the housing 70A. Each of the plugs 145 and 146 is connected to one end of a flexible hose having the other end connected to the suction pump 92.

In the liquid developing head 22Y-1A having the above described construction, even if a portion of the developing liquid ejected from the ejection hole 86 and a portion of the developing liquid within the developing liquid accumulation part 81 leak outside in the directions X1 and X2 from the end of the liquid developing head 22Y-1A along the directions X1 and X2, the leaked developing liquid portions are sucked from the side recovery holes 120, 121, 140 and 141 and forcibly recovered.

Furthermore, even if the developing liquid moves along the narrow shafts 71*a*, 71*b*, 72*a* and 72*b* on both ends of the developing roller 71 and the squeeze roller 72, the developing liquid enters the surplus developing liquid accumulation parts 127, 129, 142 and 144 along the way, and is sucked and forcibly recovered. For this reason, the developing liquid which moves along the narrow shafts 71*a*, 71*b*, 72*a* and 72*b* will not leak outside the liquid developing head 22Y-1A.

A groove 155 is formed at a root portion of each of the shafts 71*a*, 71*b*, 72*a* and 72*b*, and a spiral groove 156 is formed in a predetermined direction at a portion on the outer side of the groove 155 with respect to each of the shafts 71*a*, 71*b*, 72*a* and 72*b*, so that the developing liquid will not move along the shafts 71*a*, 71*b*, 72*a* and 72*b*. The spiral grooves 156 are formed in the predetermined direction so as to apply a force towards the central portion of the housing 70 A with respect to the developing liquid which leaks along the shafts 71*a*, 71*b*, 72*a* and 72*b* while the rollers 71 and 72 rotate.

Next, a description will be given of the internal structure of the housing 70A of the liquid developing head 22Y-1A, by referring to FIG. 10.

A blade 160 which makes contact with the developing roller 71 has a plurality of holes 161.

A bypass path 163 formed within the housing 70A extends in the direction Z1 and communicates to an exit 162 of the buffer chamber 70*c*-3 and a recovery hole 70*d*-1 (surplus developing liquid recovery path 70*d*). The blade 160 traverses the bypass path 163. The blade 160 with the holes 161 functions as a throttle plate and to direct the excessive developing liquid to the bypass path 163.

Accordingly, a large portion of the developing liquid from the buffer chamber 70*c*-3 is ejected from the ejection hole 86, but a portion of the developing liquid passes through the holes 161 of the blade 160 and enter the bypass path 163, thereby being bypassed and reaching the surplus developing liquid recovery path 70*d* via the bypass path 163. As a result, it is possible to suppress the flow rate of the developing liquid ejected from the ejection hole 86 from becoming excessively large. In addition, it is possible to more positively restrict the developing liquid from leaking outside the liquid developing head 22Y-1A.

On the other hand, a block 165 is provided within the developing liquid accumulation part 81. This block 165 is provided to narrow the recovery hole 70*d*-1. Because the recovery hole 70*d*-1 is narrow, the suction force becomes larger, and the developing liquid within the developing liquid accumulation part 81 is efficiently recovered.

Further, the present invention is not limited to these embodiments, but various variations and modifications may be made without departing from the scope of the present invention.

What is claimed is:

1. A liquid developing head which is arranged to confront a surface of an image bearing member via a developing gap and a squeeze gap and carries out a developing by use of a developing liquid, and liquid developing head comprising:

a housing;

a developing roller, supported by said housing, supplying the developing liquid to the developing gap by rotating so that a portion of the developing roller confronting the image bearing member moves in a direction which is the same as a moving direction of the surface of the image bearing member;

a squeeze roller, supported by said housing and arranged on a downstream side of said developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member;

a developing liquid supply path, formed within said housing and having an ejection hole located at a portion upstream of the developing gap relative to the moving direction of the surface of the image bearing member, supplied externally of said housing with the developing liquid; and a developing liquid recovery path, formed within said housing, directing the surplus developing liquid separately from said developing liquid supply path, forcibly recovering the surplus developing liquid in response to a suction force applied externally of said housing.

2. The liquid developing head as claimed in claim 1, wherein said developing liquid recovery path includes a recovery hole opening between the developing roller and the squeeze roller.

3. The liquid developing head as claimed in claim 1, wherein said developing liquid recovery path includes side recovery holes opening at portions on outer sides of both sides of the developing roller and the squeeze roller in a longitudinal direction of the developing roller and the squeeze roller.

4. The liquid developing head as claimed in claim 1, wherein said developing liquid recovery path includes at a starting end thereof a surplus developing liquid accumulation part which is formed at bearing portions on both sides along a longitudinal direction of the developing roller and the squeeze roller.

5. The liquid developing head as claimed in claim 1, wherein said developing liquid recovery path comprises:

a recovery hole opening between the developing roller and the squeeze roller;

side recovery holes opening at portions on outer sides of both sides of the developing roller and the squeeze roller in a longitudinal direction of the developing roller and the squeeze roller; and a surplus developing liquid accumulation part formed at bearing portions on both sides along a longitudinal direction of the developing roller and the squeeze roller at a starting end of the developing liquid recovery path.

6. The liquid developing head as claimed in claim 1, wherein said developing liquid supply path includes a buffer chamber provided at an intermediate portion thereof.

7. The liquid developing head as claimed in claim 1, which further comprises:

a blade making contact with the developing roller and a blade making contact with the squeeze roller, said housing further including a bypass path which communicates the developing liquid supply path and the developing liquid recovery path, and said blade which makes contact with the developing roller having holes and traversing the bypass path.

8. A liquid developing head as claimed in claim 1, further comprising a recovery hole defined by said housing between said developing roller and said squeeze roller to direct the surplus developing liquid to said developing liquid recovery path.

9. A developing unit comprising:

a liquid developing head which is arranged to confront a surface of an image bearing member via a developing gap and a squeeze gap and caries out a developing by use of a developing liquid, said liquid developing head comprising:

a housing, a developing roller, supported by said housing, supplying the developing liquid to the developing gap by rotating so that a portion of the developing roller confronting the image bearing member moves in a direction which is the same as a moving direction of the surface of the image bearing member, a squeeze roller, supported by said housing and arranged on a downstream side of said developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite to the moving direction of the surface of the image bearing member, a developing liquid supply path, formed within said housing and having an ejection hole located at a portion upstream of the developing gap relative to the moving direction of the surface of the image bearing member, supplied externally of said housing with the developing liquid; and a developing liquid recovery path, formed within said housing, directing the surplus developing liquid separately from said developing liquid supply path, forcibly recovering the surplus developing liquid in response to a suction force applied externally of said housing;

a developing liquid tank;

a supply pump supplying the developing liquid within said developing liquid tank to the liquid developing head;

a suction pump returning the surplus developing liquid within the liquid developing head into the developing liquid tank;

flexible hoses communicating the liquid developing head to said supply pump and said suction pump; and control means controlling operations of said supply pump and said suction pump, said control means starting the operation of said suction pump at a start of the operation, and stopping the operation of said suction pump slightly after stopping the operation of said supply pump at an end of the operation.

10. The liquid developing unit as claimed in claim 9, wherein said developing liquid recovery path of said liquid developing head includes a recovery hole opening between the developing roller and the squeeze roller.

11. The liquid developing unit as claimed in claim 9, wherein said developing liquid recovery path of said liquid developing head includes side recovery holes opening at portions on outer sides of both sides of the developing roller and the squeeze roller in a longitudinal direction of the developing roller and the squeeze roller.

12. The liquid developing unit as claimed in claim 9, wherein said developing liquid recovery path of said liquid developing head includes at a starting end thereof a surplus developing liquid accumulation part which is formed at bearing portions on both sides along a longitudinal direction of the developing roller and the squeeze roller.

13. The liquid developing unit as claimed in claim 9, wherein said developing liquid recovery path of said liquid developing head comprises:

a recovery hole opening between the developing roller and the squeeze roller;

side recovery holes opening at portions on outer sides of both sides of the developing roller and the squeeze roller in a longitudinal direction of the developing roller and the squeeze roller; and a surplus developing liquid accumulation part formed at bearing portions on both sides along a longitudinal direction of the developing roller and the squeeze roller at a starting end of the developing liquid recovery path.

14. The liquid developing unit as claimed in claim 1, wherein said developing liquid supply path of said liquid developing head includes a buffer chamber provided an intermediate portion thereof.

15. The liquid developing unit as claimed in claim 1, wherein said liquid developing head further comprises:

a blade making contact with the developing roller and a blade making contact with the squeeze roller, said housing further including a bypass path which communicates the developing liquid supply path and the developing liquid recovery path, and said blade which makes contact with the developing roller having holes and traversing the bypass path.

16. A developing unit as claimed in claim 9, further comprising a recovery hole defined by said housing disposed between said developing roller and said squeeze roller to direct the surplus developing liquid to said developing liquid recovery path.

17. An image forming apparatus comprising:

a drum-shaped image bearing member having a surface; and a developing unit comprising:

a plurality of liquid developing head respectively arranged along a periphery of said image bearing member to confront the surface of said image bearing member via a developing gap and a squeeze gap and carries out a developing by use of a developing liquid, each of said liquid developing heads comprising:

a housing, a developing roller, supported by said housing, supplying the developing liquid to the developing gap by rotating so that a portion of the developing roller confronting the image bearing member moves in a direction which is the same as a moving direction of the surface of the image bearing member, a squeeze roller, supported by said housing and arranged on a downstream side of said developing roller in the moving direction of the surface of the image bearing member, removing a surplus developing liquid adhered on the surface of the image bearing member at the squeeze gap by rotating so that a portion of the squeeze roller confronting the image bearing member moves in a direction opposite the moving direction of the surface of the image bearing member, a developing liquid supply path, formed within said housing and having an ejection hole located at a portion upstream of the developing gap relative to the moving direction of the surface of the image bearing member, supplied externally of said housing with the developing liquid; and a developing liquid recovery path, formed within said housing, directing the surplus developing liquid separately from said developing liquid supply path, forcibly recovering the surplus developing liquid in response to a suction force applied externally of said housing;

a developing liquid tank;

a supply pump supplying the developing liquid within said developing liquid tank to the liquid developing head;

a suction pump returning the surplus developing liquid within the liquid developing head into the developing liquid tank;

flexible hoses communicating the liquid developing head to said supply pump and said suction pump; and control means controlling operations of said supply pump and said suction pump, said control means starting the operation of said supply pump slightly after starting the operation of said suction pump at a start of the operation, and stopping the operation of said suction pump slightly after stopping the operation of said supply pump at an end of the operation.

18. The image forming apparatus as claimed in claim 17, wherein said developing liquid recovery path of said liquid developing head includes a recovery hole opening between the developing roller and the squeeze roller.

19. The image forming apparatus as claimed in claim 17, wherein said developing liquid recovery path of said liquid developing head includes side recovery holes opening at portions on outer sides of both sides of the developing roller and the squeeze roller in a longitudinal direction of the developing roller and the squeeze roller.

20. The image forming apparatus as claimed in claim 17, wherein said developing liquid recovery path of said liquid developing head includes at a starting end thereof a surplus developing liquid accumulation part which is formed at bearing portions on both sides along a longitudinal direction of the developing roller and the squeeze roller.

21. The image forming apparatus as claimed in claim 17, wherein said developing liquid recovery path of said liquid developing head comprises:

a recovery hole opening between the developing roller and the squeeze roller;

side recovery holes opening at portions on outer sides of both sides of the developing roller and the squeeze roller in a longitudinal direction of the developing roller and the squeeze roller; and a surplus developing liquid accumulation part formed at bearing portions on both sides along a longitudinal direction of the developing roller and the squeeze roller at a starting end of the developing liquid recovery path.

22. The image forming apparatus as claimed in claim 17, wherein said developing liquid supply path of said liquid developing head includes a buffer chamber provided an intermediate portion thereof.

23. The image forming apparatus as claimed in claim 17, wherein said liquid developing head further comprises:

a blade making contact with the developing roller and a blade making contact with the squeeze roller, said housing further including a bypass path which communicates the developing liquid supply path and the developing liquid recovery path, and said blade which makes contact with the developing roller having holes and traversing the bypass path.

24. An image forming apparatus as claimed in claim 17, further comprising a recovery hole defined by said housing disposed between said developing roller and said squeeze roller to direct the surplus developing liquid to said developing liquid recovery path.

* * * * *

UNITED STATES PATENT AND TRADEMARK OFFICE

CERTIFICATE OF CORRECTION

PATENT NO.: 5,899,606
DATED : May 4, 1999
INVENTOR(S): TANO et al.

It is certified that error appears in the above-identified patent and that said Letters Patent is hereby corrected as shown below:

On the title page of the patent insert item --[73] Assignee: Fujitsu Limited., Kawasaki-shi, Japan-- as it was omitted.

Signed and Sealed this

Second Day of May, 2000

*Attest:*

Q. TODD DICKINSON

*Attesting Officer*

*Director of Patents and Trademarks*